US009636268B1

(12) United States Patent
Bedillion

(10) Patent No.: US 9,636,268 B1
(45) Date of Patent: May 2, 2017

(54) ARTICULATING SURGICAL ARMREST

(71) Applicant: Darlene Bedillion, Hickory, PA (US)

(72) Inventor: Darlene Bedillion, Hickory, PA (US)

( * ) Notice: Subject to any disclaimer, the term of this patent is extended or adjusted under 35 U.S.C. 154(b) by 294 days.

(21) Appl. No.: 14/306,991

(22) Filed: Jun. 17, 2014

Related U.S. Application Data

(60) Provisional application No. 61/836,457, filed on Jun. 18, 2013.

(51) Int. Cl.
*A61G 13/12* (2006.01)

(52) U.S. Cl.
CPC ..... *A61G 13/1235* (2013.01)

(58) Field of Classification Search
CPC ..... A61G 13/12; A61G 13/1205; A61G 13/1235; A61G 13/124; A61G 13/1245; A61G 13/125; A61G 7/002; A61G 7/005; A61G 7/015; A61G 7/065; A61G 7/075; A61G 7/0755; A61G 5/12; A61F 5/05; A61F 5/05841; A61F 5/0585; A61F 5/05858; A61F 5/37; A61F 5/3761; Y10T 292/0843; Y10T 292/0834; Y10T 292/0836; Y10T 292/0845; Y10T 292/0863; Y10T 292/1092
USPC ..... 108/139, 140, 4
See application file for complete search history.

(56) References Cited

U.S. PATENT DOCUMENTS

| | | | | |
|---|---|---|---|---|
| 5,338 | A * | 10/1847 | Wheeler | E05B 65/0864 292/57 |
| 307,545 | A * | 11/1884 | Hart | E05B 65/0864 292/210 |
| 2,237,252 | A | 4/1941 | Longfellow | |
| 5,444,882 | A * | 8/1995 | Andrews | A61G 13/00 5/618 |
| 5,940,912 | A * | 8/1999 | Keselman | A61G 13/1235 297/411.35 |
| 6,925,668 | B2 | 8/2005 | Cuschieri et al. | |
| 7,222,826 | B1 | 5/2007 | Berglund | |
| 7,487,563 | B2 | 2/2009 | Rutherford et al. | |
| 7,823,843 | B2 | 11/2010 | Oberlaender et al. | |
| 8,230,864 | B2 | 7/2012 | Hunter, Jr. | |
| 2002/0032927 | A1* | 3/2002 | Dinkler | A61B 6/0442 5/601 |
| 2004/0073143 | A1* | 4/2004 | Bonutti | A61F 5/013 601/5 |
| 2005/0101895 | A1* | 5/2005 | Patel | A61F 5/05841 602/16 |
| 2010/0016773 | A1* | 1/2010 | DeToro | A61F 5/0585 602/16 |
| 2013/0193280 | A1* | 8/2013 | Diamante | A61G 13/1235 248/118 |

* cited by examiner

*Primary Examiner* — Kari Petrik
*Assistant Examiner* — Raymond E Harris
(74) *Attorney, Agent, or Firm* — Robert C Montgomery; Montgomery Patent & Design LP

(57) ABSTRACT

An articulating surgical armrest further includes two (2) elongated plates and a pivot hinge. A distal end of a first plate is pivotally attached to a distal end of a second plate. The plates are attached to form one (1) elongated structure in the same plane. A user rests their arm on the rest and articulates the first plate to provide range of motion for the user's arm while maintaining a muscular relaxed state in that arm.

8 Claims, 5 Drawing Sheets

ARTICULATING SURGICAL ARMREST

RELATED APPLICATIONS

The present invention was first described in and claims the benefit of U.S. Provisional Application No. 61/836,457, filed Jun. 18, 2013, the entire disclosures of which are incorporated herein by reference.

FIELD OF THE INVENTION

The presently disclosed subject matter is directed towards an adjustable structure for supporting a patient's arm during recovery from a surgical procedure.

BACKGROUND OF THE INVENTION

Individuals incurring arm injuries, or who undergo arm surgery, tend to have limited range of motion in that arm. Even those who have full range of motion, experience difficulty and pain when attempting to articulate their arm in supine or pronate orientations. This inability to articulate the arm compounds problems associated with supine and pronate surgical procedures. It is not only important to remain still during surgery, but it is just as important to position a member of the body in a certain orientation in order to perform the surgery well. Additionally, physical therapy and occupational therapy require proper posture and form when performing range of motion exercises in order to prevent further injury. Accordingly, there exists a need for a means by which an articulating armrest can be utilized during surgery or therapy to support the arm in a salutary posture while still being able to motion the arm in a desired position. The development of the present invention fulfills this need.

SUMMARY OF THE INVENTION

It is an object of the invention to provide a means to fixedly support a user's arm, particularly users who have a surgical procedure on their arm, in a selected fixed angle.

It is an object of the invention to provide such a means by providing a support device having a first planar member capable of being attached to a support structure and pivotally movable relative thereto.

A further object is to provide a means to fix a desired angle of the first planar member relative to the support structure.

It is an object of the invention to provide such a means by providing a second planar member capable of being attached to and pivotally movable relative to the first planar member.

A further object is to provide a means to fix a desired angle of the second planar member relative to the first planar member.

Yet another object of the invention is to provide a first pivoting means having a first end attached to the support structure and the second end pivotally attached to the first planar member.

In at least one (1) embodiment, the means to fix the angle between the first planar member and the support structure involves moving a latch bar point, retained within a bracket affixed to the first planar member, against the gap between a pair of teeth located on the second end of the first pivoting means.

Yet another object of the invention is to provide a second pivoting means having a first end attached to the first planar member and the second end pivotally attached to the second planar member.

In at least one (1) embodiment, the means to fix the angle between the first planar member and the second planar member involves moving a latch bar point, retained within a bracket affixed to the second planar member, against the gap between a pair of teeth located on the second end of the first pivoting means. The bracket further has a slot that limits travel of the latch bar due to a pin affixed to the latch bar travelling within the slot.

BRIEF DESCRIPTION OF THE DRAWINGS

The advantages and features of the present invention will become better understood with reference to the following more detailed description and claims taken in conjunction with the accompanying drawings in which like elements are identified with like symbols and in which:

DESCRIPTIVE KEY

Figure 1:
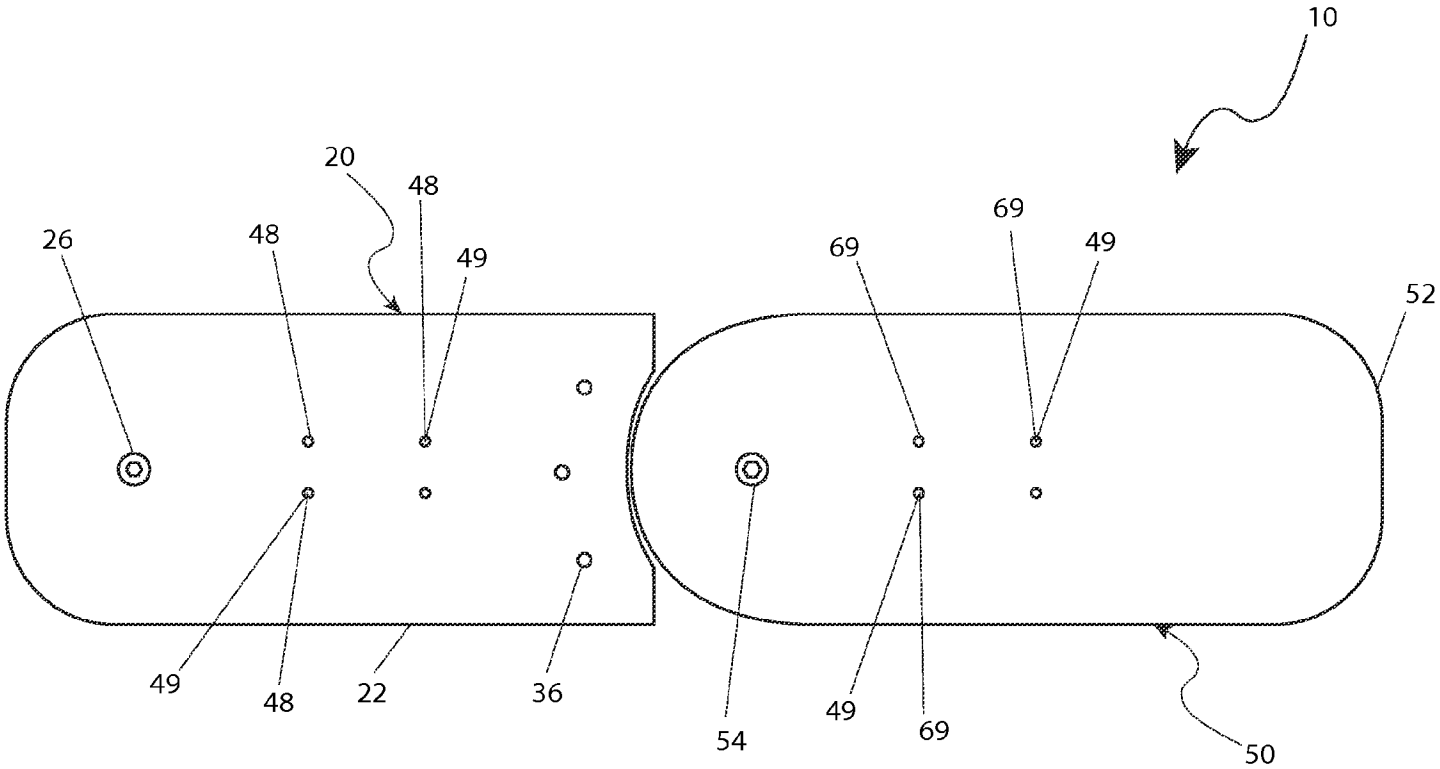
FIG. 1 is a top view of an articulating arm rest 10, according to a preferred embodiment of the present invention.

10 articulating arm rest
20 first plate assembly
22 first plate
24 first pivot bracket
25 first pivot bracket tooth
26 first pivot pin
28 first pin retainer
32 second pivot bracket
34 second pivot bracket tooth
36 second pivot bracket fastener
40 first plate latch assembly
41 first latch bar
42 first latch bar handle
43 first latch bar shaft
44 first passageway
45 first latch bar point
47 first latch retainer plate
48 first plate latch aperture
49 fastener
50 second plate assembly
52 second plate
54 second pivot pin
56 second pin retainer
60 second plate latch assembly
61 second latch bar
62 second latch bar handle
63 second latch bar shaft
64 second latch bar pin
65 second latch bar point
66 second passageway
67 second latch retainer plate
68 second latch retainer plate slot
69 second plate latch aperture

90 attachment means
95 fastening means
100 external structure
102 patient's arm

DETAILED DESCRIPTION OF THE PREFERRED EMBODIMENT

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes an articulating arm rest (herein referred to as the "device") 10, which can be attached to an external structure 100, such as an operating table, or other service table, that provides a means for holding a forearm and the corresponding upper arm 102 of a patient, or client, immobile in a variety of relative angular positions in either the supine or pronate orientation.

Referring now to FIG. 1, a top view of the device 10, according to the preferred embodiment of the present invention, is disclosed. The device 10 is comprised of a first plate assembly 20 and a second plate assembly 50. The first plate 22 and the second plate 52 each preferably comprise an aluminum plate approximately six inches (6 in.) wide. Other materials, such as stainless steel, could also be used without changing the scope of the device 10. The device 10 is intended to be attached to a pre-existing bracket on an existing external structure 100 at a proximal end. A proximal end of the first plate 22 is provided with a square end with rounded corners. A proximal end of the second plate 52 is provided with a semi-circular shape while an opposing distal end is squared with rounded corners. An opposing distal end of the first plate 22 is generally concave having a radius approximately equal to the rounded proximal end of the second plate 52. This particular geometry allows both plates 22, 52 to be on the same plane.

Figure 2:
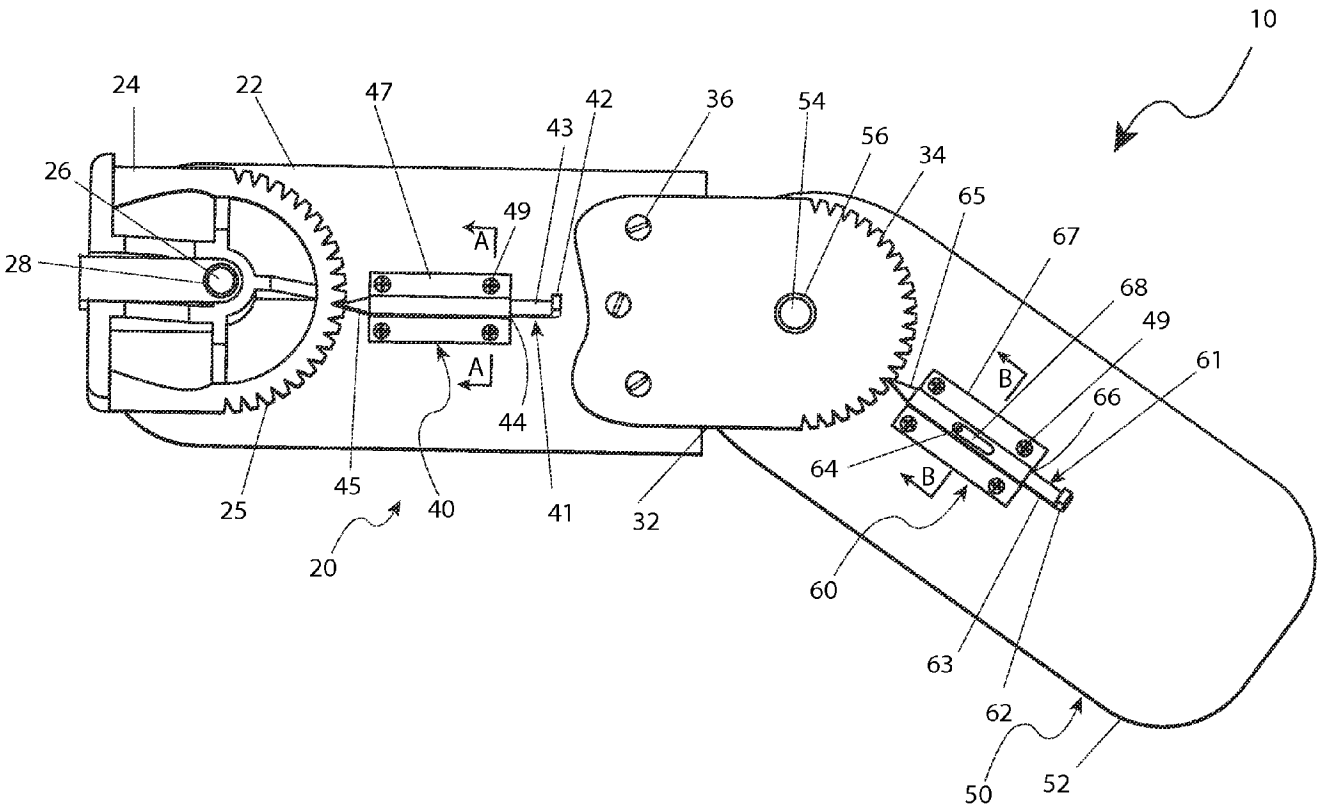
FIG. 2 is a bottom view of the articulating arm rest 10 according to a preferred embodiment of the present invention.

Referring now to FIG. 2, a bottom view of the device 10, according to the preferred embodiment of the present invention, is disclosed. A first pivot bracket 24, preferably comprised of cast aluminum, is pivotally attached to a proximal end of the first plate 22 by means of a first pivot pin 26 inserted through aligned apertures (not shown) in both of said first pivot bracket 24 and said first plate 22. The first pivot pin 26 is provided with a head, larger in diameter than the shank of the pin 26, in order to be retained in the first plate 22. The first pivot pin 26 is retained in the first pivot bracket 24 by means of a first pin retainer 28, which could be a snap ring inserted into a groove, or a lock nut, or some other means. In some embodiments, a thrust washer, envisioned to comprise a brass, oilite, or similar material, may be inserted on the first pivot pin 26 between the adjoining faces of the first pivot bracket 24 and the first plate 22 in order to prevent scoring. The first pivot bracket 24 is provided with a semi-circular profile on the distal side into which first pivot bracket teeth 25 have been formed. The first pivot bracket teeth 25 can be of a rudimentary form with tapered sides and rounded tips and roots. The purpose of the first pivot bracket teeth 25 is to be engaged by a latch bar point 45 of a latch bar 41 in the first plate latch assembly 40 affixed to the first plate 22 in order to lock the pivoting action of the first plate assembly 20.

A second pivot bracket 32, preferably comprises an aluminum or stainless steel plate, is attached to the distal end of the first plate 22 with a plurality of threaded second bracket fasteners 36. The first plate 22 is of sufficient thickness to support the threads necessary to retain the second bracket fasteners 36. The second pivot bracket 32 is provided with second pivot bracket teeth 34, which are similar in profile to the first pivot bracket teeth 25 and disposed in a semi-circular pattern.

Figure 4:
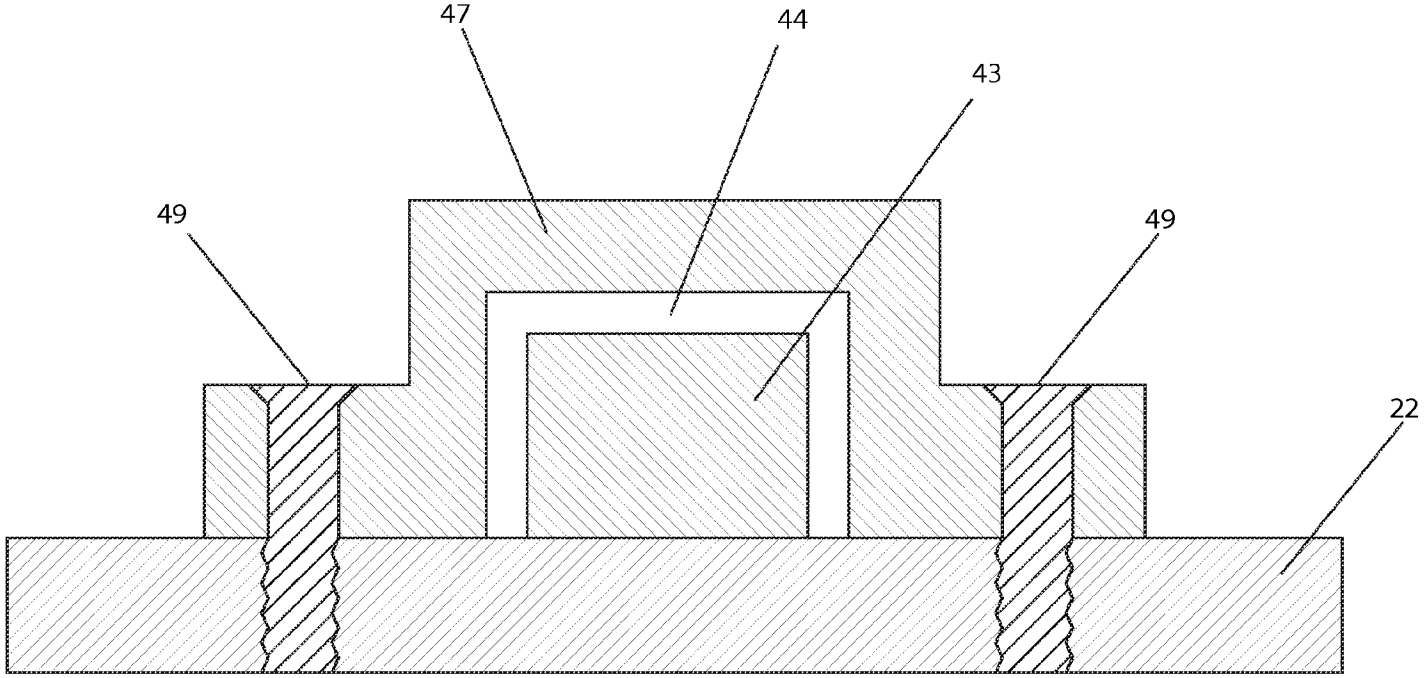
FIG. 4 is a sectional view of the first latching assembly 40 along the line A-A (see FIG. 2), according to a preferred embodiment of the present invention; and, FIG. 5 is a sectional view of the second latching assembly 60 (along line B-B (see FIG. 2), according to a preferred embodiment of the present invention.

Referring now to FIG. 4, a first plate latch assembly 40 is disposed upon the underside of the first plate 22 between the proximal end and the distal end. As stated previously, the purpose of the first plate latch assembly 40 is to lock the pivoting action of the first plate assembly 20. The first plate latch assembly comprises a first latch bar 41 and a first latch retainer plate 47 attached to the first plate 22 by means of a plurality of fasteners 49 inserted into threaded first plate latch apertures 48 (see FIG. 1). The first latch retainer plate 47 preferably comprises a metal material, and is shaped in a series of ninety degree (90°) bends to form a passageway 44 to confine the first latch bar 41, except in a longitudinal direction. The first latch bar 41 preferably comprises a metal bar and is further modified to have a portion of a first end symmetrically tapered to form a first latch bar point 45 and a portion of a second end bent ninety degrees (90°) to form a first latch bar handle 42 with a latch bar shaft 43 between these features. The first latch bar point 45 is fitted into a gap between two (2) of the first pivot bracket teeth 25 with the first latch bar handle 42 oriented away from the first plate 22. The first latch retainer plate 47 is placed over the first latch bar 41 such that the first latch bar shaft 43 is located in the passageway formed into the first latch retainer plate 47 and secured with a plurality of fasteners 49. The second pivot bracket 32 is located on the first plate 22 adjacent to said first plate latching assembly 40 to limit travel thereof. Specifically, the first latch bar 41 is limited to being retained within the passageway 44 of the latch bar retainer plate 47 when the first latch bar handle 42 abuts against the first end of the second pivot bracket 32.

The proximal end of the second plate 52 is provided with an aperture (not shown) located at a center of the semi-circle, which will accommodate the second pivot pin 54. The second pivot pin 54 is inserted through the aligned apertures (not shown) in the second plate 52 and the second pivot bracket 32 to pivotally attach the proximal end of said second plate 52 to the distal end of the first plate 22. The second pivot pin 54 is retained in the second pivot bracket 32 means of a second pin retainer 56, which could be a snap ring inserted into a groove, or a lock nut, or some other means.

Figure 5:
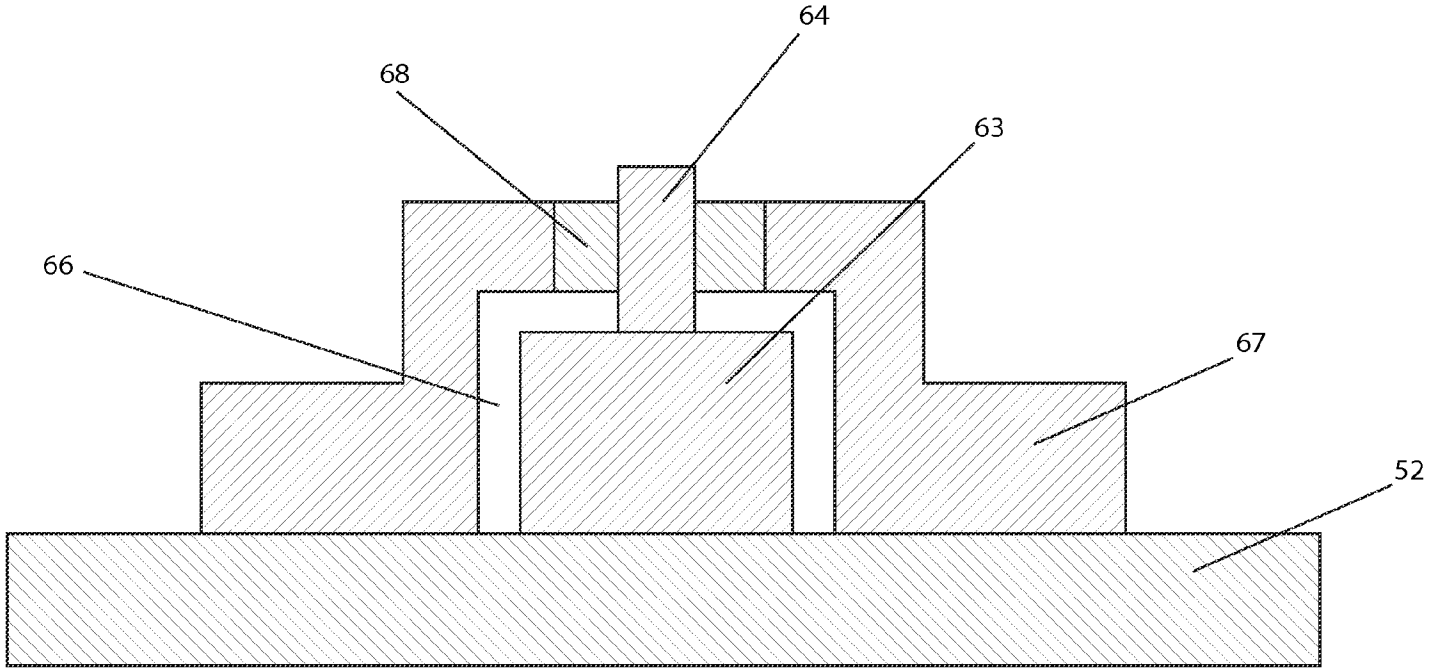

Referring now to FIG. 5, disposed on the underside of the second plate 52 in proximity to the second pivot bracket 32 is a second plate latch assembly 60, which provides a means to lock the pivoting action of the second plate assembly 50 relative to the first plate assembly 20. The second plate latch assembly 60 comprises a second latch bar 61 and a second latch retainer plate 67 attached to the second plate 52 by means of a plurality of fasteners 49 inserted into threaded second plate latch apertures 69 (see FIG. 1). The second latch retainer plate 67 preferably comprises a metal material and is shaped in a series of ninety degree (90°) bends to form a passageway 66 to confine the second latch bar 61, except in a longitudinal direction. The second latch retainer plate 67 is further provided with a second latch retainer plate slot 68. The second latch bar 61 preferably comprises a metal bar and is further modified to have a portion of a first end symmetrically tapered to form a second latch bar point 65 and a portion of a second end bent ninety degrees (90°) to form a second latch bar handle 62, having a latch bar shaft 63 between these features.

Disposed in the second latch bar shaft 63 is a second latch bar pin 64, which is envisioned as a cylindrical piece, such as a roll pin, pressed into an aperture. The second latch bar point 65 is fitted into a gap between two (2) of the second pivot bracket teeth 34 with the second latch bar handle 62 oriented away from the second plate 52. The second latch retainer plate 67 is placed over the second latch bar 61 such that the second latch bar shaft 63 is located in the passageway 66 formed into the second latch retainer plate 67 and the second latch bar pin 64 is inserted into the second latch retainer plate slot 68. The second latch retainer plate 67 is secured with a plurality of fasteners 49. The second latch bar pin 64 inserted into the second latch retainer plate slot 68 is thus able to further restrict the longitudinal positioning of the second latch bar 61 to be sure that it is not dislodged from the second latch retainer plate 67. In other embodiments of the present device 10, a spring could be incorporated into one (1) or both of the latch assemblies 40, 60 to keep the latch bar points 45, 65 positively engaged in the respective teeth 25, 34 when a user is not making pivotal adjustments.

Figure 3:
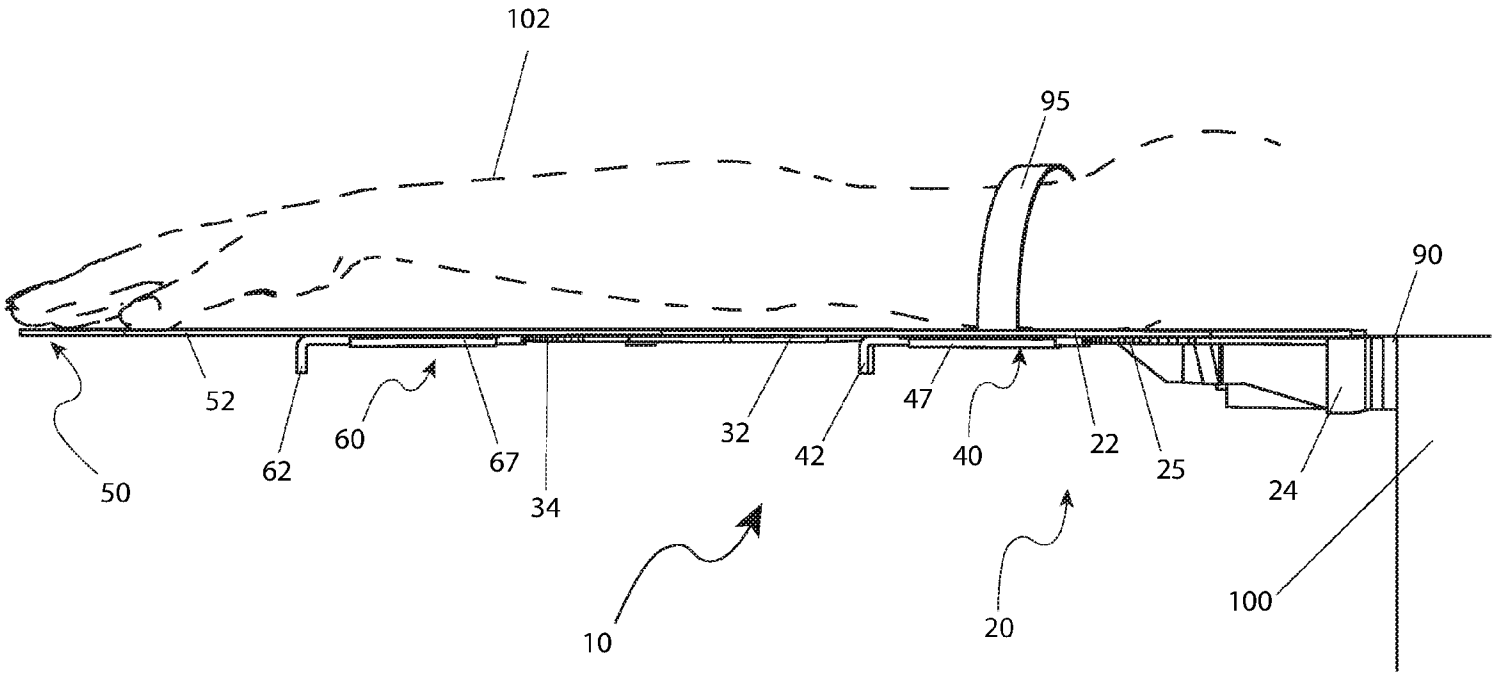
FIG. 3 is an environmental view of the articulating arm rest 10, with a patient's arm 102 supported thereon according to a preferred embodiment of the present invention.

Referring now to FIG. 3, an environmental view of the device 10 with a patient's arm 102 in a pronate orientation supported thereon according to the preferred embodiment of the present invention, is disclosed. An attachment means 90 is capable of removably attaching the device 10 to an external structure 100. It is envisioned that in some embodiments a fastening means 95, such as a strap, or combination of straps, could be added to the device 10 in order to restrict the movement of a patient's arm 102.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by an enabled user in a simple and straightforward manner with little or no additional training by performing a series of steps. It can be appreciated that the operational steps can be performed in alternative order and as such any operational description of use should not be viewed as a limiting factor. After initial purchase or acquisition of the device 10, it would be installed as indicated in FIG. 3.

The method of utilizing the device 10 may be achieved by performing the following steps: attaching the device 10 to an existing bracket on an external structure 100, such as an existing table, bench, or stand, via an attachment means 90; placing the patient's or client's arm 102 onto the device 10 with the forearm on the second plate assembly 50 and the upper arm on the first plate assembly 20; securing the patient's or client's arm 102 to the device 10 via a fastening means 95, if desired or required; pushing the first latch bar handle 42 away from the first pivot bracket 24 thus sliding the first latch bar 41 and disengaging the first latch bar point 45 from the first pivot bracket teeth 25; adjusting the disposition angle of the device 10 relative to the table, bench, or stand, and thus the patient's or client's arm 102 at the shoulder joint, to the desired position; sliding the first latch bar 41 toward the first pivot bracket 24 and thus moving the first latch bar point 45 into engagement with the first pivot bracket teeth 25 and locking the pivot; pushing the second latch bar handle 62 away from the second pivot bracket 32 thus sliding the second latch bar 61 and disengaging the second latch bar point 65 from the second pivot bracket teeth 34; adjusting the disposition angle of the second plate assembly 50 relative to the first plate assembly 20, and thus the patient's or client's arm 102 at the elbow joint, to the desired position; sliding the second latch bar 61 toward the second pivot bracket 24 and thus moving the second latch bar point 45 into engagement with the second pivot bracket teeth 25 and locking the pivot; and, carrying out the intended procedure.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. An articulating armrest comprising:

a first planar member, having a first end and a second end;

a second planar member, having a first end and a second end;

a first pivoting means attached to said first end of said first planar member and adapted to enable pivoting motion of said first planar member with respect to an external structure;

a second pivoting means pivotally attaching said second end of said first planar member to said first end of said second planar member to enable pivoting motion of said second planar member with respect to said first planar member;

an attachment means to removably attach said first pivoting means to said external structure;

a first arresting means to selectively secure said first pivoting means to form a first desired fixed angle between said first planar member and said structure; and, a second arresting means to selectively secure said second pivoting means to form a second desired fixed angle between said first planar member and said second planar member;

wherein said armrest is capable of supporting a user's arm in an immobile state; and, wherein said second pivoting means is located adjacent to said first arresting means to limit travel thereof.

2. The armrest recited in claim 1, further comprising at least one fastening means to secure a user's arm to a surface of said armrest.

3. The armrest recited in claim 1, wherein said first and second planar members and said first and second pivoting means are aluminum.

4. The armrest recited in claim 1, wherein said first and second planar members are each approximately six inches in width.

5. The armrest recited in claim 1, wherein said first pivoting means comprises:

a pivot bracket pivotally attached to said first planar member with a pivot pin; and, a plurality of pivot bracket teeth located on a semi-circular second side of said pivot bracket;

wherein said first arresting means is capable of selectively engaging one of said plurality of pivot bracket teeth at said first desired fixed angle.

6. The armrest recited in claim 5, wherein said first arresting means further comprises:

a latch bar retainer plate affixed to said first planar member, having a passageway longitudinally formed therein; and, a latch bar confined and capable of longitudinal travel within said passageway, comprising a handle portion and terminating in a latch bar point;

wherein said latch bar point is capable of engaging said one of said plurality of pivot bracket teeth to form said first desired fixed angle; and, wherein said latch bar is limited to being retained within said passageway when said handle portion abuts against said second pivoting means.

7. The armrest recited in claim 1, wherein said second pivoting means comprises:

a pivot bracket having a first end affixed to said first planar member and a second end pivotally attached to said second planar member with a pivot pin; and, a plurality of pivot bracket teeth located on a semi-circular second side of said pivot bracket;

wherein said second arresting means is capable of selectively engaging one of said plurality of pivot bracket teeth at said second desired fixed angle; and, wherein said pivot bracket first end limits travel of said first arresting means.

8. The armrest recited in claim 7, wherein said second arresting means further comprises:

a latch bar retainer plate affixed to said second planar member, having a passageway longitudinally formed therein and a slot;

a latch bar confined and capable of longitudinal travel within said passageway, comprising a handle portion and terminating in a latch bar point;

a latch bar pin affixed to and perpendicularly extending outward from said latch bar such that said latch bar pin extends through said slot;

wherein said latch bar point is capable of engaging said one of said plurality of pivot bracket teeth to form said second desired fixed angle; and, wherein said slot limits travel of said latch bar due to said latch bar pin.

* * * * *